US006544147B1

(12) United States Patent
Wang et al.

(10) Patent No.: US 6,544,147 B1
(45) Date of Patent: Apr. 8, 2003

(54) ROCKER ARM FOR AN ELECTRIC TREADMILL

(76) Inventors: Leao Wang, No.1, Lane 233, Sec.2, Charng Long Rd., Taiping 411 (TW); Peter Wu, No.1, Lane 233, Sec.2, Charng Long Rd., Taiping 411 (TW)

( * ) Notice: Subject to any disclaimer, the term of this patent is extended or adjusted under 35 U.S.C. 154(b) by 0 days.

(21) Appl. No.: 09/994,454

(22) Filed: Nov. 28, 2001

(51) Int. Cl.[7] ..... A63B 22/02
(52) U.S. Cl. ..... 482/54
(58) Field of Search ..... 482/51, 54, 138, 482/139, 62, 72, 73, 57

(56) References Cited

U.S. PATENT DOCUMENTS 4,949,951 A * 8/1990 Deola ..... 482/138
5,171,196 A * 12/1992 Lynch ..... 482/54
5,688,209 A * 11/1997 Trulaske et al. ..... 482/54
5,707,319 A * 1/1998 Riley ..... 482/54

* cited by examiner

*Primary Examiner*—Stephen R. Crow
(74) *Attorney, Agent, or Firm*—Troxell Law Office PLLC; Kuo-Hsiung Chiu

(57) ABSTRACT

The present invention relates to a rocker arm for an electric treadmill which includes an upright frame, a base frame, a front supporting leg and a rear supporting leg. A console is mounted on the upright frame, and a handrail is fitted to either side thereof. A continuous belt circles therearound for an in-place rotation. In addition, two rocker arms fitted to the upright frame can be held by both hands of a user for a forward and backward swinging movement. Each of both rocker arms with identical construction includes a connecting rod and a holding swing arm with a handle. The bottom end of the connecting rod is pivotably connected to the upright frame by means of a pivot while the top end of the connecting rod is pivotally connected to the holding swing arm as well.

3 Claims, 4 Drawing Sheets

ROCKER ARM FOR AN ELECTRIC TREADMILL

BACKGROUND OF THE INVENTION

1. Field of the Invention

The present invention relates to a rocker arm for an electric treadmill, and more particularly, to a device which adjusts to the curvature of the natural swing of the arms of the treadmill's user and, therefore, makes a synchronic movement.

2. Description of the Prior Art

Many commercially available electric treadmills are provided with two rocker arms swingable backward and forward along with both arms of the operator and fitted to an upright frame, a base frame or a handrail. Even, a resistant element is added to the rocker arms so that the operator can exercise the arm muscle while walking. These disclosures can be seen in U.S. Pat. No. 5,460,586, 5,527,245, 5,688,209, 5,431,612, 5,207,622, 5,860,894, 5,709,632.

The rocker arms of the above-mentioned disclosures are swung in parabolic form since they are composed of a single element in combination with.a single pivotal point. This point is evidently contrary to the natural exercise mode of the human body so that the user feels uncomfortably during the exercise session when he holds the rocker arms.

SUMMARY OF THE INVENTION

It is a primary object of the present invention to remove the above-mentioned drawbacks and to provide a rocker arm for an electric treadmill whose movement path corresponds to the natural swing curvature of the user's hands in order to reach the expected exercise effect.

It's another object of the present invention to provide a rocker arm for an electric treadmill which is provided with a resistance element (e.g. balance weight, small-type hydraulic cylinder unit, etc.) in order to make full use of the rocker arms.

DESCRIPTION OF THE DRAWINGS

The accomplishment of this and other objects of the invention will become apparent from the following description and its accompanying drawings of which.

DETAILED DESCRIPTION OF THE PREFERRED EMBODIMENT

Figure 1:
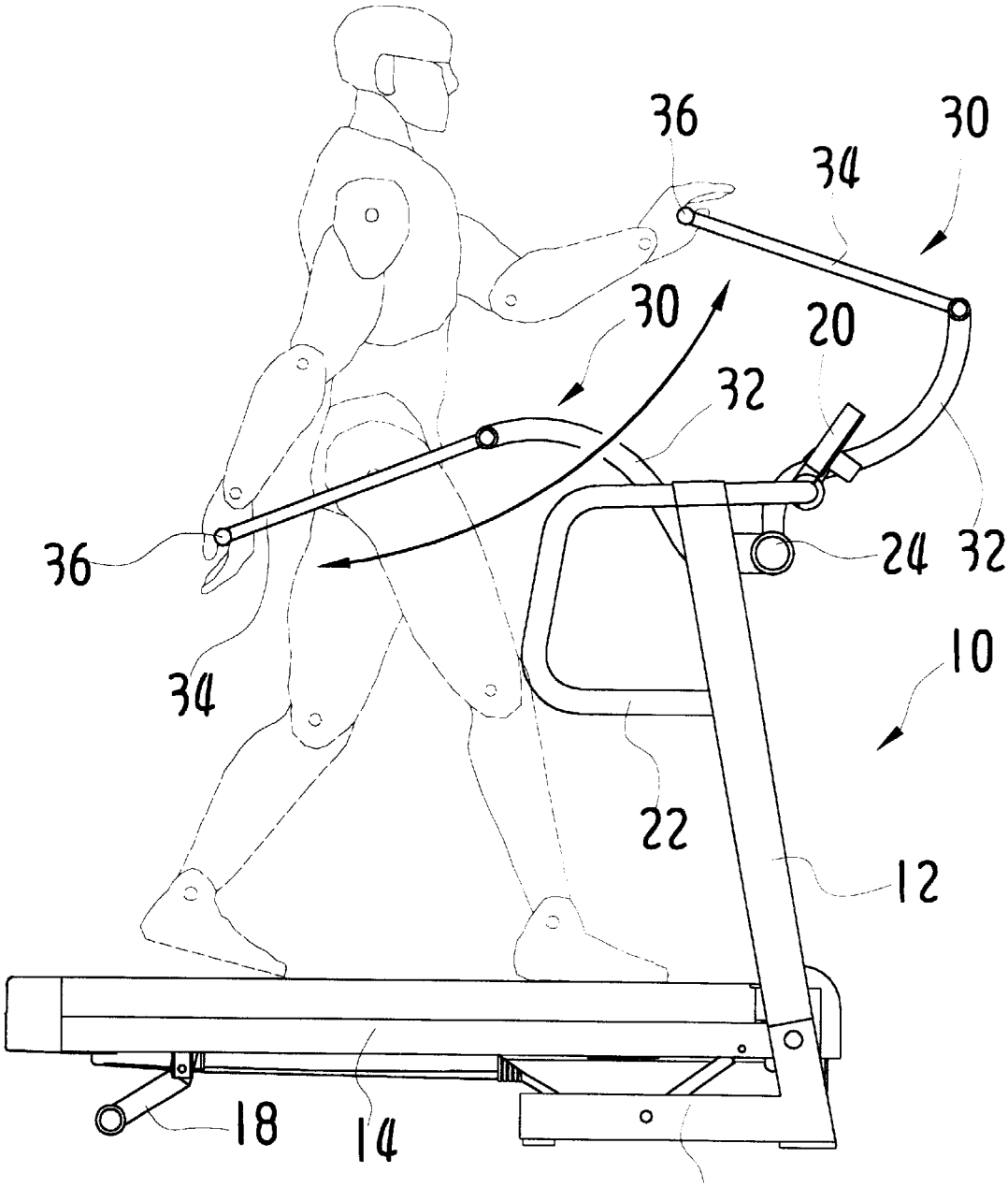
FIG. 1 is a schematic drawing of a preferred embodiment of the present invention.
Figure 2:
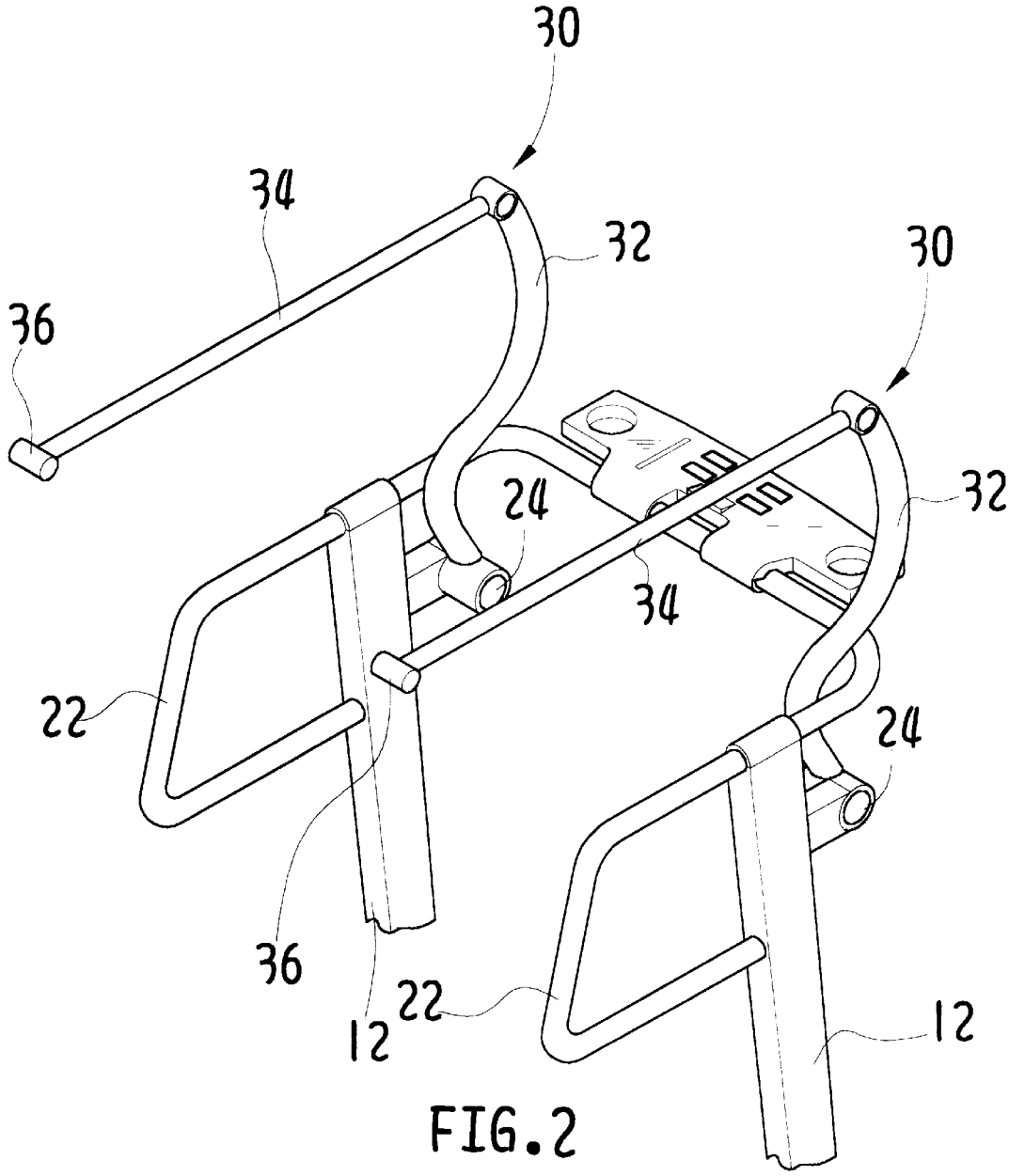
FIG. 2 is a perspective view of FIG. 1.

First of all, referring to FIG. 1 and 2, a first embodiment of the present invention fixed to the main frame of the electric treadmill 10 includes an upright frame 12, a base frame 14, a front supporting leg 16 and a rear supporting leg 18. A console 18 is mounted on the upright frame 12, and a handrail 22 is fitted to either side thereof. A continuous belt (not shown) circles therearound for an in-place rotation. In addition, two rocker arms 20 fitted to the upright frame 12 can be held by both hands of a user for a forward and backward swinging movement. Each of both rocker arms 30 with identical construction includes a connecting rod 32 and a holding swing arm 34 with a handle 36. The bottom end of the connecting rod 32 is pivotally connected to the upright frame 12 by means of a pivot 24 while the top end of the connecting rod 32 is pivotally connected to the holding swing arm 34 as well.

The movement path of the side frame 30 is able to correspond to the natural swing curvature of the both hands of the operator by means of the pivotal connection of the connecting rod 32 and the holding swing arm 34.

At least a counterweight (not shown) can be hung on the holding swing arm 34 or the handle 36 to create an exercise resistance for hardening the arm muscles.

Figure 3:
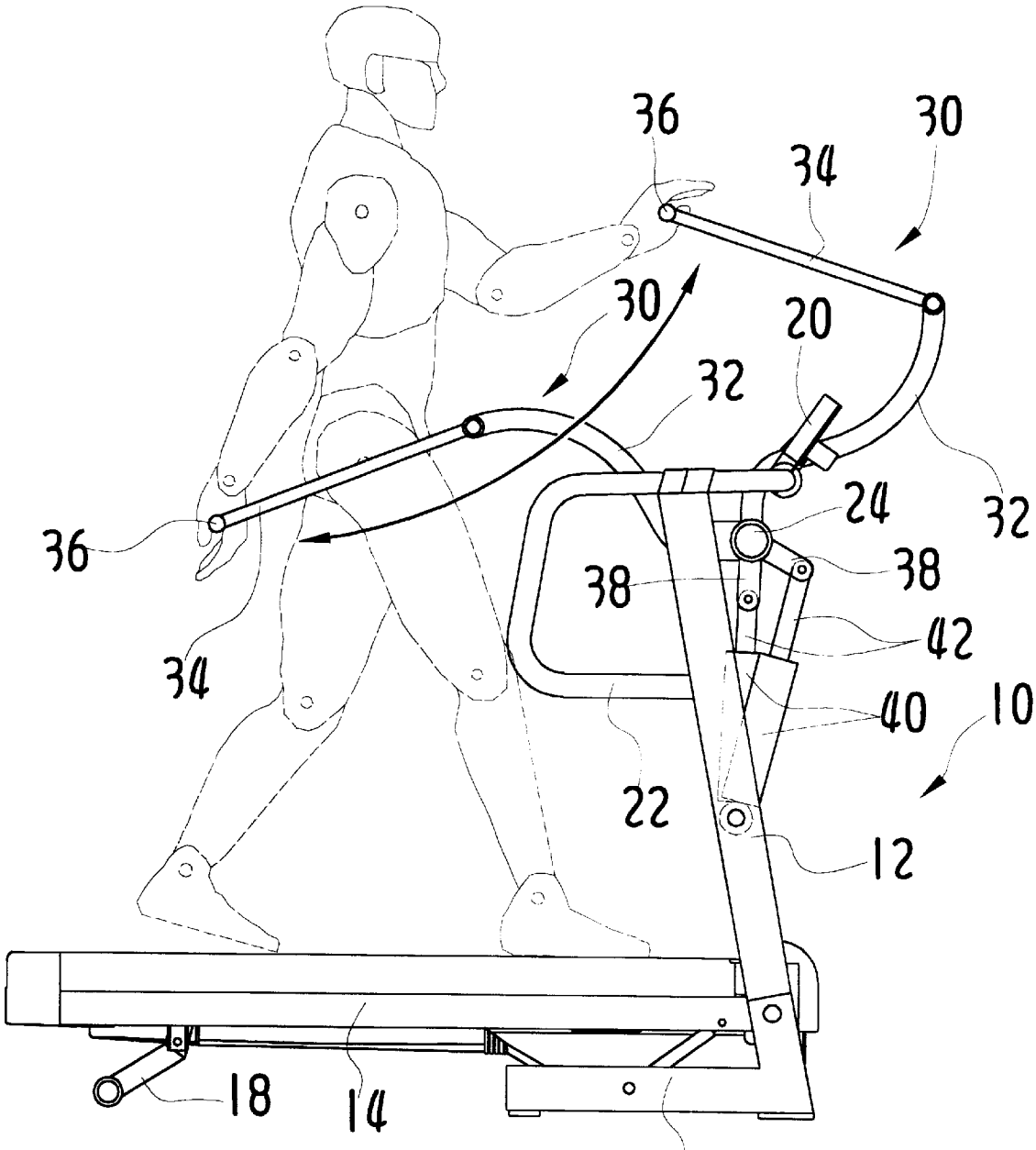
FIG. 3 is a schematic drawing of another preferred embodiment of the present invention.
Figure 4:
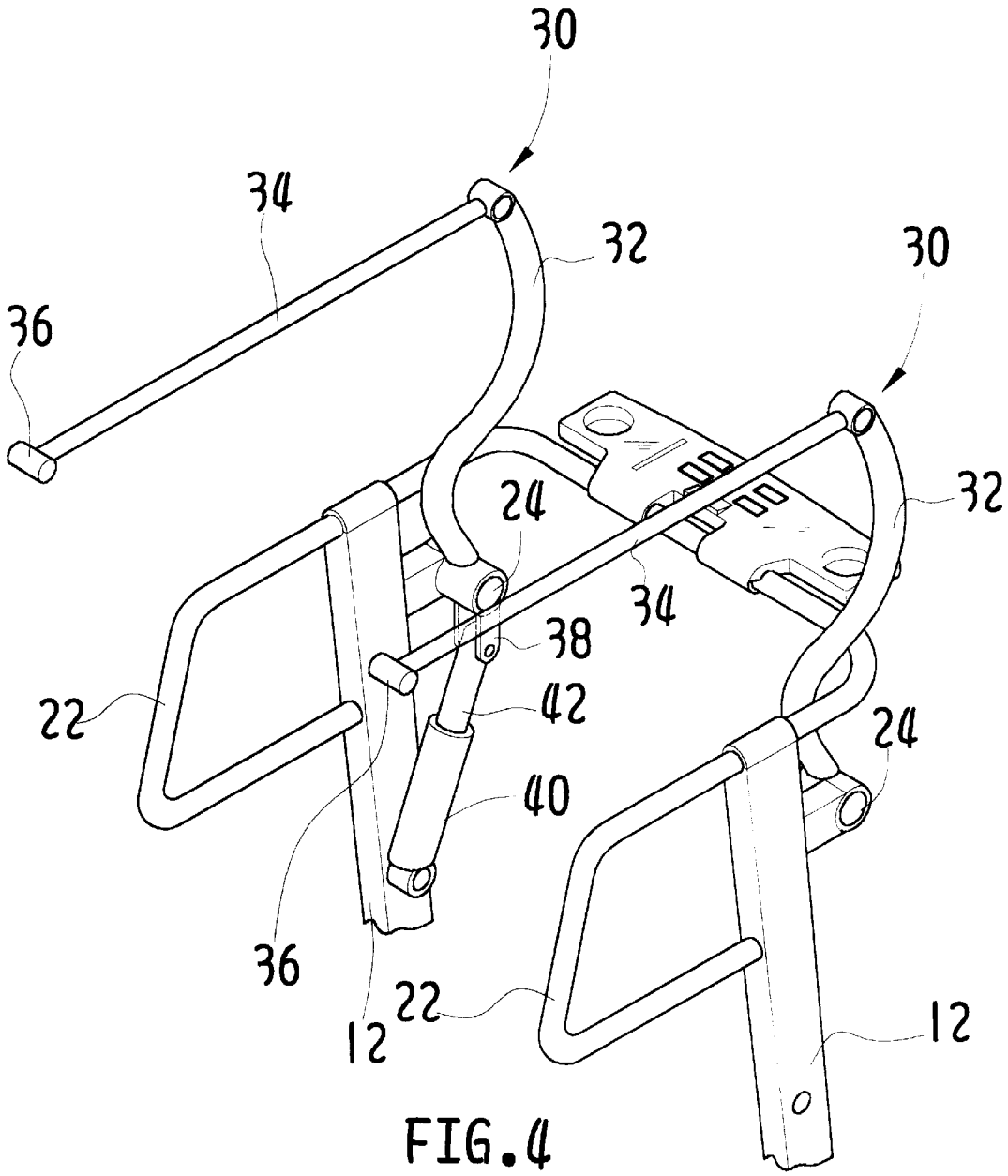
FIG. 4 is a perspective view of FIG. 3.

As shown in FIGS. 3 and 4, a small-type hydraulic cylinder 40 is fitted to both rocker arms 30 to create another exercise resistance. An extension post 38 is pivotably connected between the connecting rod 32 and a shaft 42 of the hydraulic cylinder 40. Meanwhile, the bottom end of the hydraulic cylinder 40 is pivotably connected to the upright frame 12. Accordingly, an expected exercise resistance is attainable when the connecting rod 32 turns on the pivot 24.

Many changes and modifications in the above-described embodiments of the invention can, of course, be carried out without departing from the scope thereof. Accordingly, to promote the progress in science and the useful arts, the invention is disclosed and is intended to be limited only by the scope of the appended claims.

What is claimed is:

1. A rocker arm treadmill including a base frame with a continuous belt, and an upright frame extending upwardly from the base frame adjacent to a front end of the base frame, the upright frame having a rear side facing toward a rear end of the base frame, and an opposite facing front side, and comprising:

a) a fixed handrail on the upright frame and extending from the rear side of the upright frame; and, b) a pair of rocker arms, each rocker arm including a connecting rod having a first end pivotally connected to the front side of the upright frame, and a second end, and a swing arm pivotally connected to the second end of the connecting rod.

2. The rocker arm treadmill of claim 1 further comprising a handle on each of the swing arms.

3. The rocker arm treadmill of claim 1 further comprising an hydraulic cylinder connected between the connecting rod and the upright frame.

* * * * *